US009680245B2

(12) United States Patent
Warwick et al.

(10) Patent No.: US 9,680,245 B2
(45) Date of Patent: Jun. 13, 2017

(54) SINGULATED ELASTOMER ELECTRICAL CONTACTOR FOR HIGH PERFORMANCE INTERCONNECT SYSTEMS AND METHOD FOR THE SAME

(71) Applicant: R&D Circuits, Inc, South Plainfield, NJ (US)

(72) Inventors: Thomas P Warwick, Melbourne, FL (US); James V Russell, New Hope, PA (US); Demick McMullin, Boise, ID (US); William Quick, Belleville, NJ (US)

(73) Assignee: Abacus Finance Group LLC, New York, NY (US)

( * ) Notice: Subject to any disclaimer, the term of this patent is extended or adjusted under 35 U.S.C. 154(b) by 0 days.

(21) Appl. No.: 14/830,019

(22) Filed: Aug. 19, 2015

(65) Prior Publication Data

US 2015/0372408 A1 Dec. 24, 2015

Related U.S. Application Data

(62) Division of application No. 13/815,737, filed on Mar. 15, 2013, now Pat. No. 9,153,890.

(60) Provisional application No. 61/687,084, filed on Apr. 18, 2012.

(51) Int. Cl.

| | |
|---|---|
| ***H01R 12/00*** | (2006.01) |
| ***H01R 13/03*** | (2006.01) |
| ***H01R 43/26*** | (2006.01) |
| ***H01R 13/24*** | (2006.01) |
| *H01R 12/52* | (2011.01) |

(52) U.S. Cl.
CPC ..... *H01R 13/03* (2013.01); *H01R 13/2414* (2013.01); *H01R 43/26* (2013.01); *H01R 12/52* (2013.01); *Y10T 29/4921* (2015.01); *Y10T 29/49208* (2015.01)

(58) Field of Classification Search
CPC .... H01R 23/722; H01R 23/725; H01R 11/18; H01R 13/2421; H05K 7/1084; H05K 7/1069; H05K 7/1023
USPC ..... 439/66, 70–74, 482, 700, 824
See application file for complete search history.

(56) References Cited

U.S. PATENT DOCUMENTS 5,399,108 A * 3/1995 Lu ..... H01R 9/091 439/682
6,464,511 B1 * 10/2002 Watanabe ..... G01R 1/07371 439/66
6,769,919 B2 * 8/2004 Kosmala ..... H01R 23/688 439/66

(Continued)

*Primary Examiner* — Thanh Tam Le
(74) *Attorney, Agent, or Firm* — Richard B. Klar, Esq.; Law Office Richard B. Klar

(57) ABSTRACT

A method and an electrical interconnect mechanism in which elastomeric pins are printed onto metal retainer tabs having at least one protrusion or tab extending laterally therefrom to engage a catch or recess of the laminated housing so as to locate each of the elastomeric pins and secure them within the housing. In one embodiment a champher may be employed with a catch or recess to engagely secure a second protrusion or tab extending laterally from another side of said elastomeric pin. In another embodiment the elastomeric pin may have a solid metal ring or a slide collar around the center of the pin wherein the ring has one or two tabs for engaging the recess in the housing and if preferred also the recess of a champfer.

8 Claims, 11 Drawing Sheets

(56) References Cited

U.S. PATENT DOCUMENTS

| | | | | |
|---|---|---|---|---|
| 7,666,000 | B1 * | 2/2010 | Hsiao | G01R 1/0466<br>439/66 |
| 7,794,237 | B1 * | 9/2010 | Terhune, IV | H01R 13/2407<br>439/66 |
| 7,815,438 | B2 * | 10/2010 | Kazama | G01R 1/06722<br>439/66 |
| 7,874,880 | B2 * | 1/2011 | Fedde | G01R 1/0483<br>439/66 |
| 9,153,890 | B2 * | 10/2015 | Warwick | H01R 13/03 |

* cited by examiner

SINGULATED ELASTOMER ELECTRICAL CONTACTOR FOR HIGH PERFORMANCE INTERCONNECT SYSTEMS AND METHOD FOR THE SAME

RELATED APPLICATIONS

This is a non provisional application of a provisional application Ser. No. 61/687,084 by Thomas P. Warwick, et al. filed Apr. 18, 2012

BACKGROUND

1. Field

The present disclosure relates to a singulated elastomeric electrical contactor for high performance interconnect systems and a method of the same. In particular, the present disclosure relates to a method and a system for replaceable elastomeric pins with a mechanism for locating and securing these pins within a housing.

2. The Related Prior Art

An electrical interconnect mechanism includes at least two electrically conductive contact pads, an electrically conductive path connecting such contact pads, a housing, a compressing structure, and some form of compliant, mechanically resistive mechanism that allows the pads to press against aligned electrical pads of two objects in need of electrical connection.

Three contact technologies are primarily used in the industry from prior art. The first uses a metal spring. While several variations exist for this type of contact technology in the electronics industry, the basic principle is this: a coiled or linear spring in the individual contactor compresses between two contact pads or regions. The spring provides the required force and mechanical hysteresis. As the dominant technology in the electronics industry, this method has the primary benefit of long life, excellent mechanical hysteresis, and the ability to replace individual contact mechanisms easily. This is also the most universal electrical contactor technology for high performance applications.

The second contact technology employs a small metallic rocker for pressing against a non-conductive polymeric elastomer of various durometers. The polymeric elastomer provides a required force and a mechanical hysteresis. When an object is pressed into the individual rocker, the rocker pushes back as one or more ends presses against the elastomeric spacer. This technology however is rather limited by the shape and type of object for which electrical contact is to be made. The main benefit of this technology is the long life of the contactors and the ease with which an individual contactor can be replaced.

The third type of mechanical contactor involves a polymeric elastomeric material filled with metal particles. While several varieties of this general class of contactor exist, all such conductive elastomers are formed in a sheet or a plane, and the individual contactors must be grouped together in a matrix. The primary benefit of the conductive elastomeric contactor is electrical performance—both contact resistance and very high frequency performance. In critical RF parameters elastomeric contactors out-perform equivalent metal contactors approximately 10:1 (self-inductance). However, individual pins cannot be replaced, as elastomers are built either on or in sheets. Another critical issue with the elastomer is lifetime degradation due to over-compression. A final problem is that in elastomeric sheets, individual contact points cannot act independent of one another, making the sheets difficult to use in applications where the connecting objects have poor co-planar properties.

It would be desirable to provide an electrical interconnect mechanism with the following key criteria:

First, a key criterion would be addressing the resistive force that presses against the objects in need of connection. While force is needed to maintain the connection, a high amount of force is required in mechanically complex structures in order to press the objects together.

Next, a compliance range is required to absorb the mechanically coplanar differences between the two objects.

A mechanical hysteresis is needed so that the aforementioned resistive force will return the contact pad to a nominal position after being compressed.

Another criterion is that of the physical size of the interconnect system, X-Y direction (often described as "pitch").

Also important is the physical height of the interconnect system, Z direction, which most often relates to critical performance properties in very high speed, digital, and RF interconnect systems.

An electrical property known as "contact resistance" (CRES), which describes the degrading loss of energy to heat in the interconnect system is yet another criterion.

Long Lifetime of the interconnect system in its use environment is also important.

The ability to make the system configurable from just a few interconnects to several thousand is important as well.

Low cost and ease of replacing an individual interconnect mechanism when damaged or fatigued from use (end of life) is another important consideration or criterion.

SUMMARY

The present disclosure provides for a method and an electrical interconnect mechanism in which elastomeric pins are formed onto one or more metal retainer tabs each having at least one protrusion or tab extending laterally therefrom to engage a catch or recess of a laminated or formed housing so as to locate each of the elastomeric pins and secure them within the housing. In one embodiment champhering may be employed with a catch or recess in the housing to engagingly secure a protrusion or tab extending laterally from a side of said elastomeric pin. In another embodiment the elastomeric pin may have a solid metal ring or a side collar around the center of the pin wherein the ring has one or more tabs for engaging the recess in the housing and if preferred also the recess with a champfer. The present disclosure can be used for improving systems such as shown in U.S. Pat. Nos. 7,326,064 and 7,297,003.

DETAILED DESCRIPTION OF THE PREFERRED EMBODIMENTS

Referring now to FIGS. 1-11 of the drawings, the present disclosure offers a method and a mechanical interconnect system for electrical interconnects that provides for replaceable individual elastomeric contactors that can be located and secured within a housing and still provide enhanced electrical conductive properties.

Figure 1:
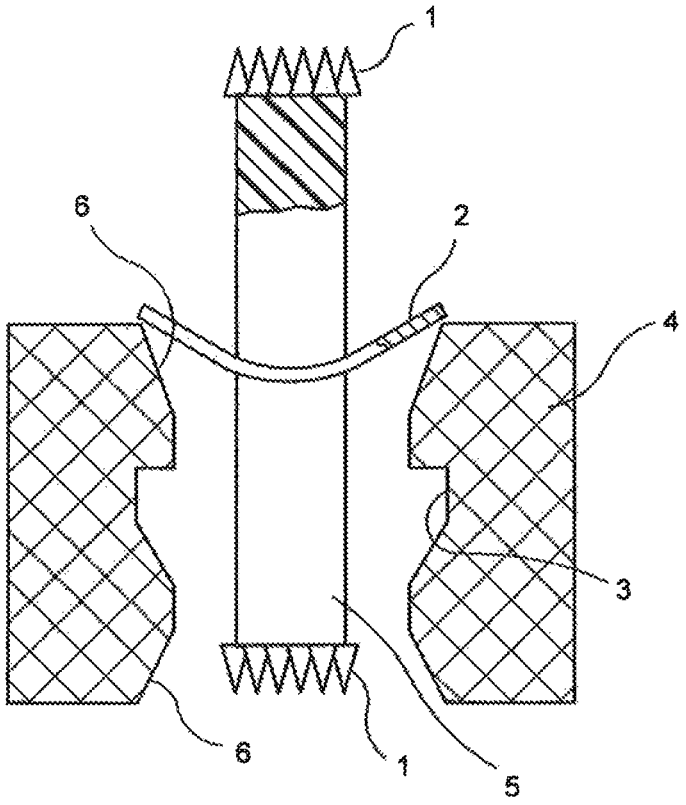
FIG. 1 illustrates a sectional view of a first embodiment of the present disclosure in which a singulated elastomeric pin prior to compression into housing is depicted in accordance with the present disclosure.

FIG. 1 illustrates the basic concept in a first embodiment of the interconnect system of the present disclosure. The contactor crowns (1), which are optional, press into the objects for which it is desirous to make electrical connection. As the objects are pressed together, the conductive elastomeric connector material (5) is compressed. The conductive elastomeric connector (5) provides both the necessary force and the conductive paths to make the electrical connection thru the contact mechanism. The housing (4) provides structural support, aligns/retains the individual elastomeric contactor (5), and prevents damage to the elastomeric via over-compression.

Figure 2:
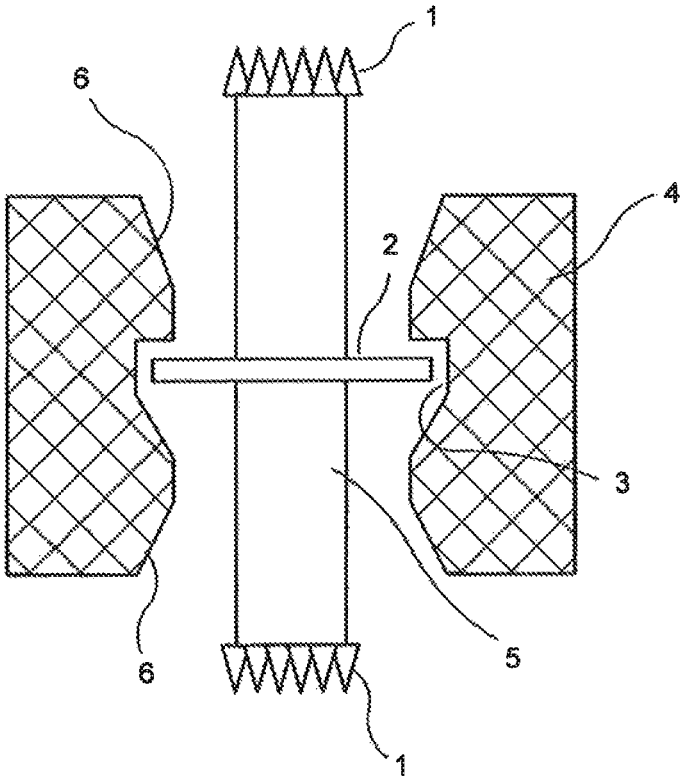
FIG. 2 illustrates a sectional view of a first embodiment of the present disclosure of FIG. 1 in which a singulated elastomeric pin after insertion into a housing is depicted in accordance with the present disclosure.
Figure 5:
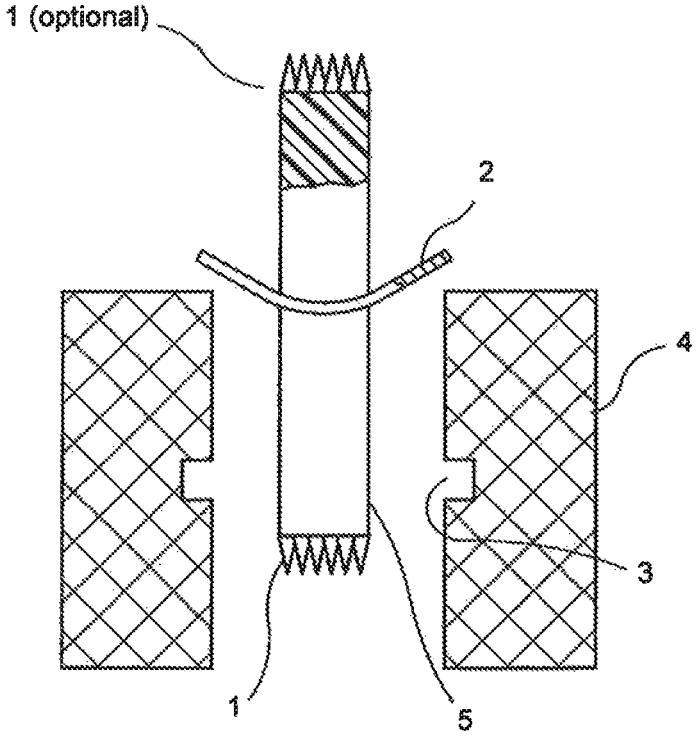
FIG. 5 illustrates a sectional view of another embodiment of the present disclosure in which a singulated elastomeric pin prior to insertion into housing is depicted similar to that of FIG. 1 but without a champher in the housing and in accordance with the present disclosure.

A retaining tab (2) and a catch for the tab in the housing 4) both provide the mechanisms for assembling the interconnect system and replacing an individual elastomeric contactor (5). The housing, preferably manufactured in a laminated or in an ejected molding fashion, permits an individual contactor (5) to be pressed into the housing (4) by bending metal tabs (2) to either side of the contactor (5). The metal tabs (2) extend laterally from the contactor (5) as shown in FIG. 1. The optional champher (6) helps to guide the tabs (2) into the locked position. Once in place, the tabs (2) return to their previous horizontal state. There is preferably some clearance between the dimensions of the tabs (2) and the catches (3) so that the tabs (2) can be removed from the catches when the elastomeric contactor (5) is replaced. This is shown in FIG. 2. An alternative embodiment is illustrated in FIG. 5 in which the housing 4 is depicted without the optional champher. In this embodiment tabs (2) are needed to engage the catches (3) of the housing (4).

Figure 3:
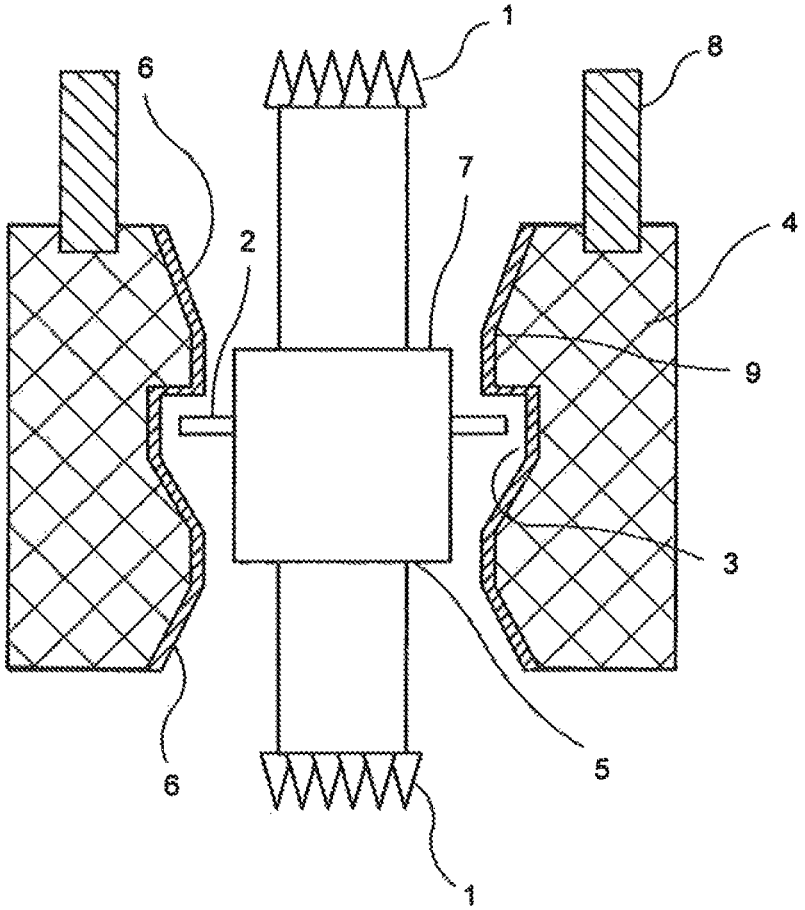
FIG. 3 illustrates a sectional view of a first embodiment of the present disclosure of FIG. 2 in which a singulated elastomeric pin after insertion into a housing is depicted with plating being provided for better electrical conductivity and an optional metal retainer column and an optional BGA stop in accordance with the present disclosure.
Figure 4:
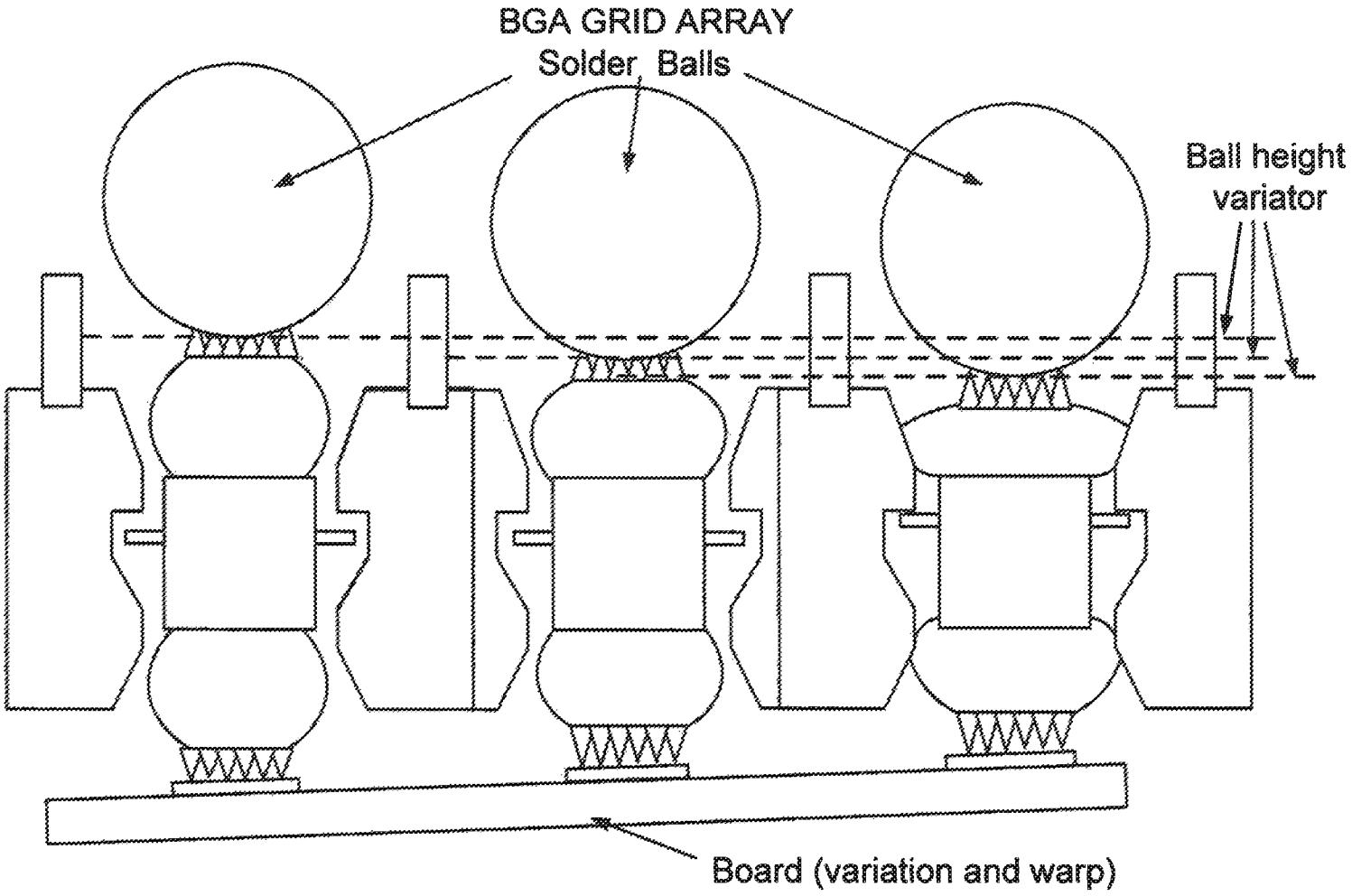
FIG. 4 illustrates a sectional view of a grid array of the present disclosure in which singulated elastomeric pins are compressed by solder balls in accordance with the present disclosure.

As the technology reduces in size, it may become necessary to guide the contactor into its location. FIG. 3 illustrates another embodiment of the present disclosure in which the singulated elastomeric contactor is guided by placing a solid metal ring around the center of the elastomeric contactor to provide a slide collar (7). This slide collar (7) has the added benefit of preventing the elastomeric contactor from expanding into the catch opening in the laminated housing (4) when the elastomeric contactor is in a compressed state. This is ensured when the slide collar's (7) length extends the full length of the catch opening while considering the possible travel of the latched probe. To further reduce binding, the inside hole of the housing (4) may be plated with a metal lining (9) (See FIG. 3). This also serves to improve electrical connectivity. Depending on the application, the housing (4) may be extended to prevent over-compression of the elastomeric contactor. (8) (BGA Stop) (see FIG. 3).

In operation, the singulated elastomeric contactor will be placed between two objects that desire an electrical connection. The objects will be pressed together using mechanical force. As the objects press together, the elastomeric contactor begins to compress. In compression it supplies the force necessary to drive the optional crown points (1) into the object. This breaks through dirt and oxides on an object. The conductive elastomeric (5) also conducts electrical current with very low contact resistance when compressed. Because each elastomeric contactor moves independently of its neighbor, the invention allows adaptation to mechanical co-planar concerns in the connecting objects (see FIG. 4).

Figure 6:
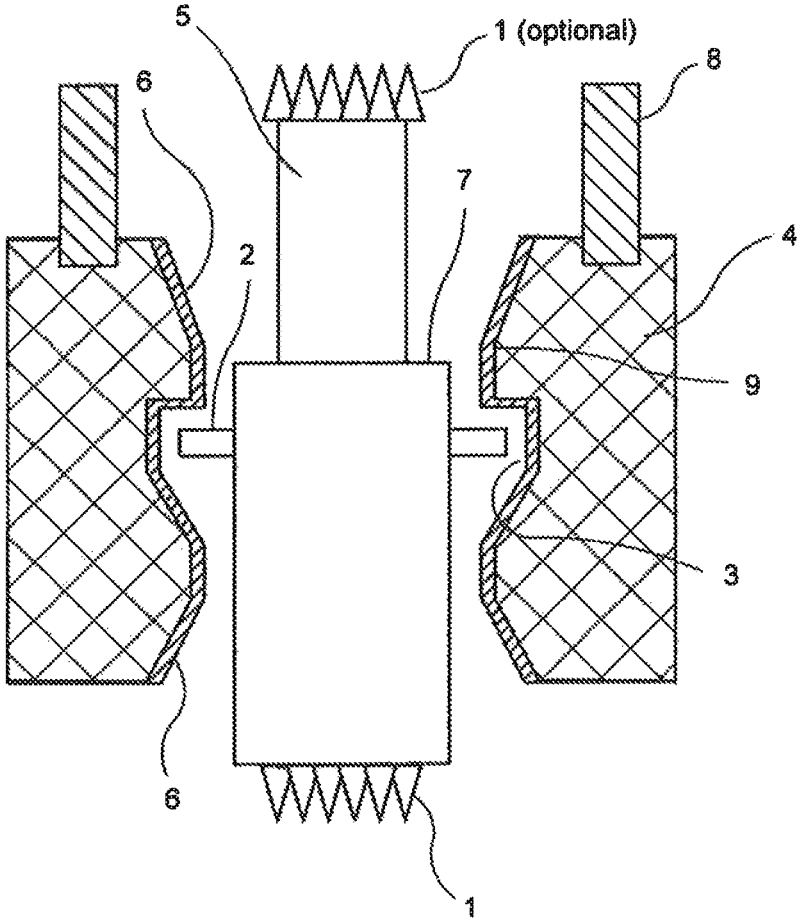
FIG. 6 illustrates a sectional view of another embodiment of the present disclosure in which a singulated elastomeric pin after insertion into a housing is depicted similar to FIG. 2 but with a slide collar and a metal plating lining the opening in the housing in accordance with the present disclosure.

Another embodiment of the present disclosure is shown in FIG. 6 where the conductive elastomeric column (5) is formed on only one side of the slide collar (7) and a contact (1) is formed on the bottom of the slide collar (7). Additionally the bottom of the slide collar (7) can be flat for direct solder attach to a desired object. Further, while all the aforementioned contactors (1) are illustrated with a crown tip configuration, it should be understood that the contact could be formed in numerous configurations dependent on the application and the present disclosure is not limited to any specific configuration.

Figure 7:
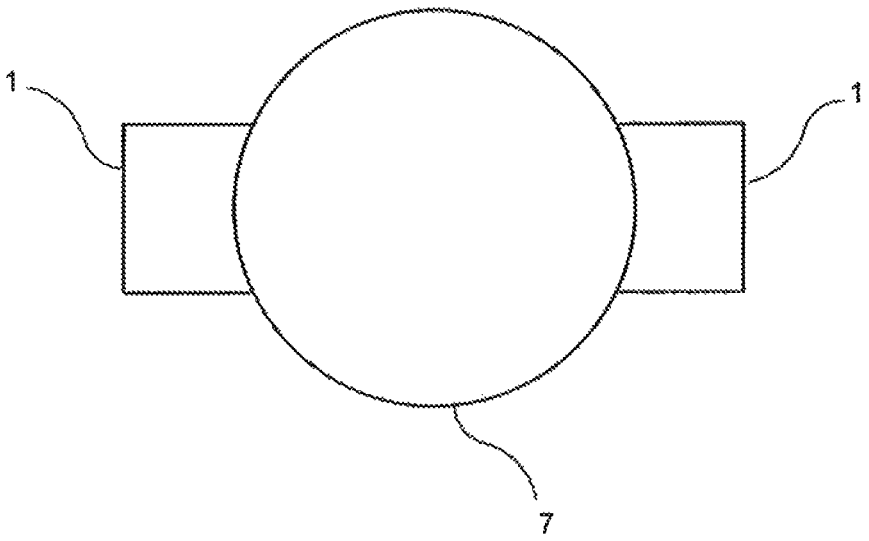
FIG. 7 illustrates a top view of another embodiment of the present disclosure of a singulated elastomeric pin depicted in accordance with the present disclosure.

FIG. 7 illustrates a top view of the metal retainer tabs (1) with a slide collar (2). It should be noted that the retainer tabs (1) can be any number or else shaped as a solid ring around the slide collar.

Figure 8:
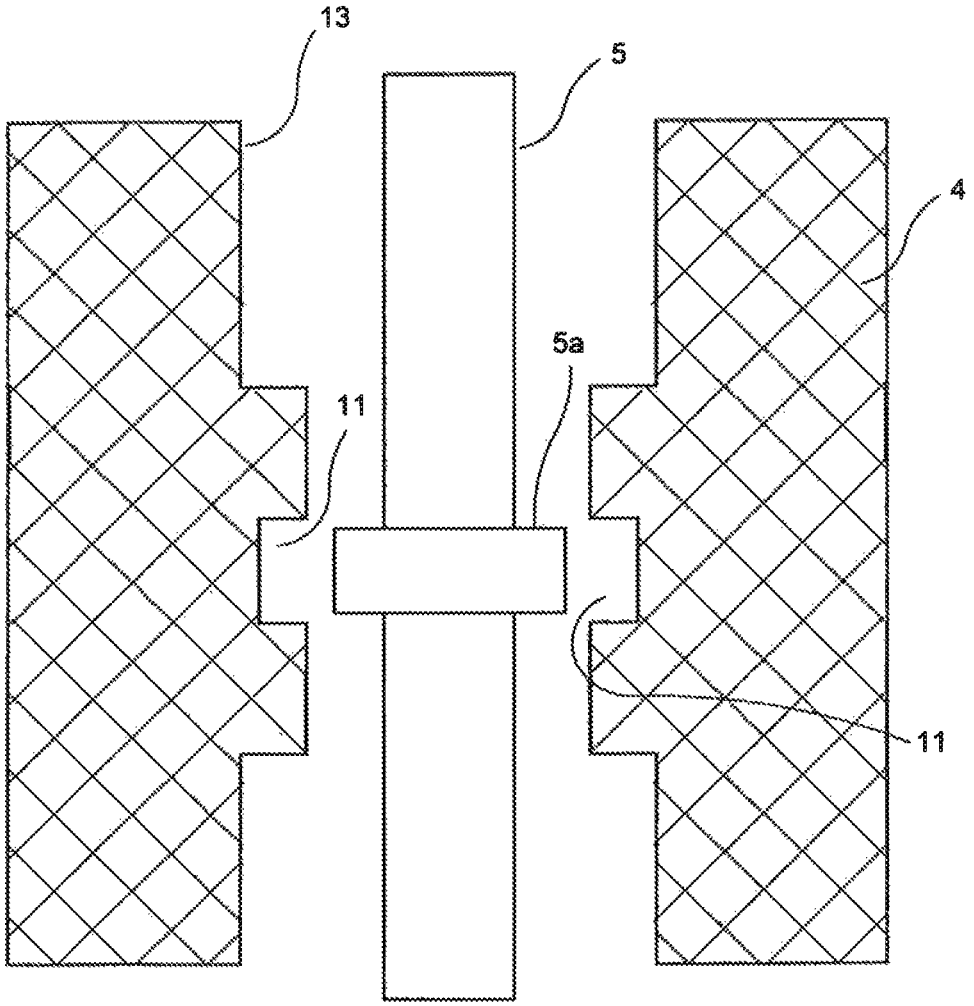
FIG. 8 illustrates yet another embodiment of the present disclosure in which the elastomer pin is formed with one or more protrusions extending laterally to provide a retaining mechanism for engaging the catches in the housing wherein the housing is used as a catching stop to retain the pin in place.
Figure 9:
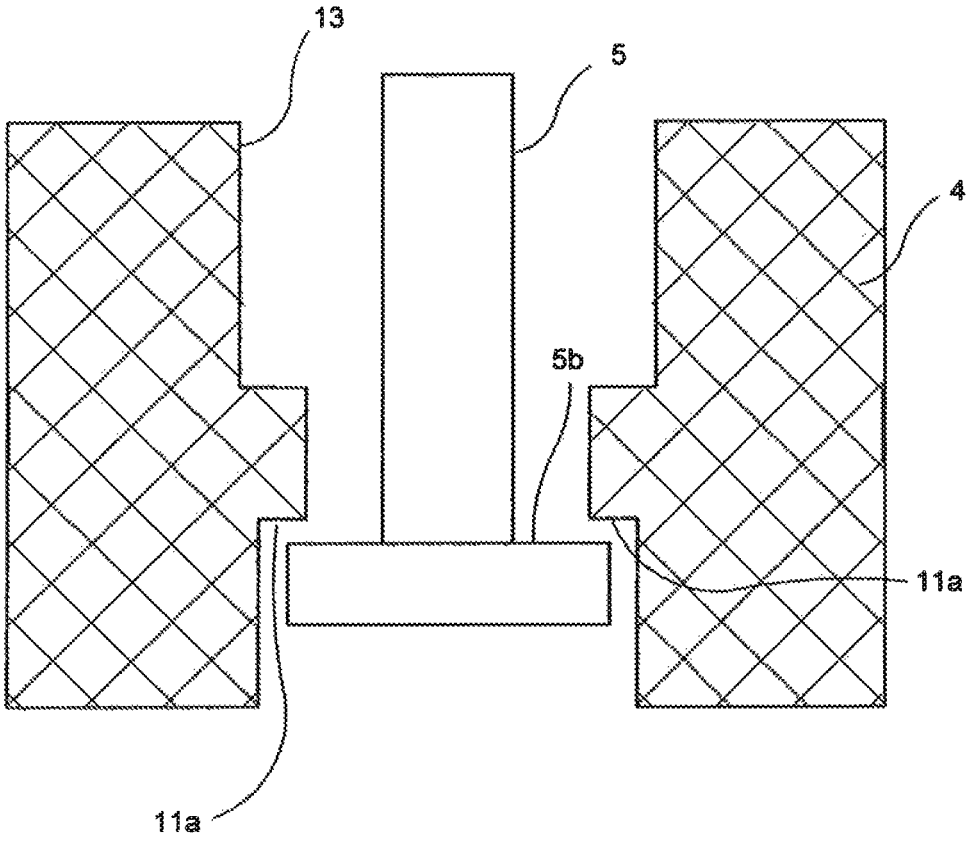
FIG. 9 is another embodiment of the present invention in which like the embodiment of FIG. 8 the elastomer pin is formed to provide a retaining mechanism however in this embodiment the one or more protrusions are formed as a nail head shape of the elastomer in and engaging laterally protruding tabs for the catches or protrusions of the housing.

FIGS. 8 and 9 show two additional embodiments of the present disclosure in which the retaining mechanism 5*a* for the elastomer pin 5 is formed as part of the elastomer pin 5 and preferably made of the same elastomer material. In FIG. 8 in which the elastomer pin 5 is formed with protrusions 5*a* extending laterally from each side of and possibly including the entire perimeter of the pin 5 to provide a retaining mechanism 5*a* for engaging the catches 11 in the housing 4 and optionally included a chamfered surface of the interior of the housing where the pin 5 is inserted for the purposes of guiding the pin 5 into the catch or catches or protrusions of the housing 4. In this way the retaining mechanism 5*a* can be formed as a one piece unit made solely of elastomer or conductive elastomer material and reduces the cost of utilizing a separate retaining material to retain the pin 5 in place. The protrusions can be formed as a continuous ring around the perimeter of the pin 5 or else alternatively as one, two or more tabs or protrusions off the sides of the pin 5.

Figure 10:
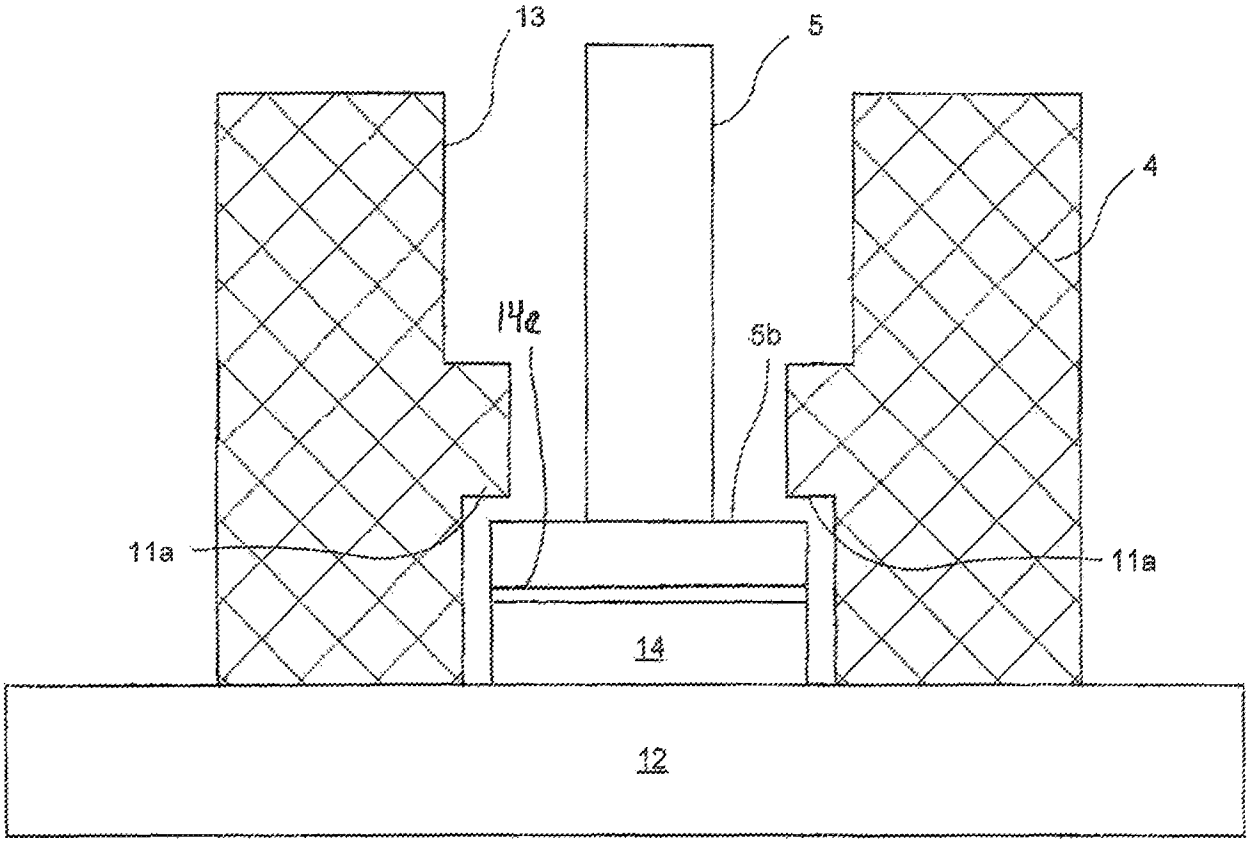
FIG. 10 shows the embodiment of FIG. 9 with a printed circuit board or electrical device for placement underneath the elastomer pin to prevent the nail head shaped elastomer pin from slipping down and out of the housing.

In the embodiment of FIG. 9 as with the embodiment of FIG. 8, the elastomer pin 5 is formed to provide a retaining mechanism 5*b*. In this embodiment however the protrusions 5*b* are formed as a nail head shape 5*b* as part of the elastomer pin 5 and engages laterally protruding tabs or other protrusions 11*a* of the housing 4 and if optionally included the chamfered surfaces of the interior of the housing 4 where the pin 5 is inserted). Once again the retaining mechanism 11*a* can be formed as a one piece unit made solely of elastomer material and reduces the cost of utilizing a separate retaining material to retain the pin 5 in place, This time the pin 5 is formed with a nail head configuration 5*b* locked in place with the protrusions 11*a* of the optional chamfered surface(s) of the housing 4. The bottom of the housing is either permanently bonded or compressed via an optional compression mechanism such as but not limited to screws or fastening mechanisms known in the art but also can be fastened by temporary or permanent adhesive or epoxy or any other bonding agents known in the art. It should be noted that the same bonding technique can be utilized on the top and bottom of each compression stop and/or housing and/or BOA stop for each embodiment of the present invention therefore alleviating the need for a mechanical fastening mechanism such as but not limited to screws or other such fastening mechanisms. In this fashion the bottom of the housing provides alignment for the bottom of the nail head at the bottom of the pin to align to an electrical component such as but not limited to a pad of a printed circuit board 12 (*pcb*) thereby holding the nail head portion of the pin in place as shown in FIG. 10 The nail head portion of the pin can be formed to encompass the entire perimeter of the pin 5. It is further understood that the housing 4 acts as an over compression stop for each of the embodiments in the present disclosure.

Figure 11:
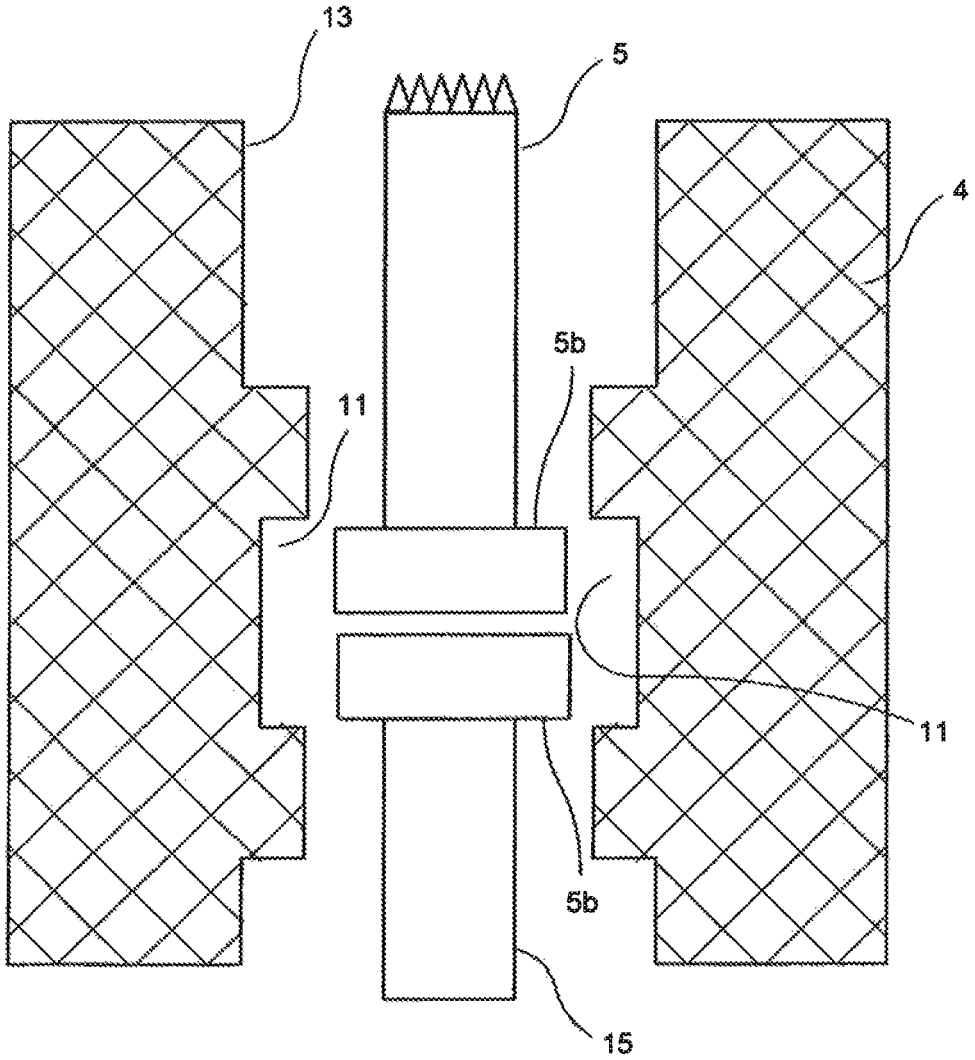
FIG. 11 is another embodiment somewhat similar to the embodiment in FIG. 10 in which the elastomer pin is formed as two separate pins each having a nail head shaped protrusion for engaging the tabs of the housing.

FIG. 11 is another embodiment somewhat similar to the embodiment in FIG. 10 in which the elastomer pin 5 is formed one of two separate pins, the other one being a metal pin, each having a nail head shaped protrusion 5*b* for engaging the catches 5 of the housing 4.

While presently preferred embodiments have been described for purposes of the disclosure, it is understood that numerous changes in the arrangement of apparatus parts can be made by those skilled in the art. Such changes are encompassed within the spirit of the invention as defined by the appended claims.

What is claimed:

1. An electrical interconnect mechanism, comprising:

at least one electrically conductive elastomeric pin fixedly placed into at least one retainer tab having at least one bendable electrically conductive protrusion extending laterally therefrom, said at least one bendable electrically conductive protrusion being connected to at least one side of said elastomeric conductive pin; and a housing having a catch or recess for engagement with said protrusion of said tab so as to guide and locate said at least one elastomeric pin and removably secure it said protrusion in place within said catch or recess of the housing and provide a physical retention of said protrusion with said recess or catch of said housing and an electrical conduit, said tab being formed as a solid metal ring configured as a slide collar and located around a center of said elastomeric pin, said elastomeric pin being located on one side of the metal slide collar guide without an elastomeric contactor.

2. An electrical interconnect mechanism, comprising:

at least one electrically conductive elastomeric pin fixedly placed into at least one retainer tab having at least one bendable electrically conductive protrusion extending laterally therefrom, said at least one bendable electrically conductive protrusion being connected to at least one side of said pin; and a housing having a catch or recess for engagement with said protrusion of said tab so as to guide and locate said at least one elastomeric pin and removably secure said protrusion in place within said catch or recess of the housing and provide a physical retention of said protrusion with said recess of said housing and said tab within said catch or said recess of said housing providing an electrical conduit and a retaining mechanism for the elastomeric pin.

3. The mechanism according to claim 2 wherein said retaining mechanism is formed as protrusions extending laterally from each side of said pin to provide a retaining mechanism for engaging the retaining tab of the housing.

4. The mechanism according to claim 2 wherein said housing is provided with one or more chamfered surfaces in said housing's interior wherein said pin is inserted to guide said pin within said housing said chamfer having catches or protrusions for engaging said laterally extending protrusions said pin.

5. The mechanism according to claim 2 wherein the retaining mechanism can be formed as a one piece unit made solely of elastomer material.

6. The mechanism according to claim 2 wherein the elastomer pin is formed to provide a retaining mechanism in a shape of a nail head shape for the elastomer pin and engaging laterally protruding tabs or catches for the optionally chamfered surface of the housing so as to engage the nail head shaped protrusion of the pin.

7. The mechanism according to claim 2 wherein the retaining mechanism for the elastomer pin is formed as part of the elastomer pin.

8. The mechanism according to claim 2 wherein the retaining mechanism can be formed as a one piece unit made solely of elastomer material.

* * * * *